US012317950B2

(12) United States Patent
Chang et al.

(10) Patent No.: US 12,317,950 B2
(45) Date of Patent: Jun. 3, 2025

(54) TORSION-RESISTANT THREE-DENSITY HIGH RIGIDITY MIDSOLE

(71) Applicants: LEGO STONE CO., LTD., Taichung (TW); Chung-Hao Chang, Taichung (TW)

(72) Inventors: Chung-Hao Chang, Taichung (TW); Chia-Ying Chang, Taichung (TW)

(73) Assignee: LEGO STONE CO., LTD., Taichung (TW)

( * ) Notice: Subject to any disclaimer, the term of this patent is extended or adjusted under 35 U.S.C. 154(b) by 0 days.

(21) Appl. No.: 18/488,899

(22) Filed: Oct. 17, 2023

(65) Prior Publication Data

US 2024/0172837 A1 May 30, 2024

(30) Foreign Application Priority Data

Nov. 30, 2022 (TW) ..... 111145964

(51) Int. Cl.
*A43B 13/12* (2006.01)
*A43B 13/04* (2006.01)
*A43B 13/18* (2006.01)

(52) U.S. Cl.
CPC ..... *A43B 13/127* (2013.01); *A43B 13/04* (2013.01); *A43B 13/187* (2013.01)

(58) Field of Classification Search
CPC ..... A43B 13/127; A43B 13/04; A43B 13/34; A43B 23/22
USPC ..... 36/25 R
See application file for complete search history.

(56) References Cited

U.S. PATENT DOCUMENTS

| | | | | |
|---|---|---|---|---|
| 4,580,359 | A * | 4/1986 | Kurrash | A43B 5/001 36/107 |
| 6,601,319 | B1 * | 8/2003 | Clements | A43B 9/06 36/35 A |
| 8,056,261 | B2 * | 11/2011 | Nakano | A43B 13/12 36/35 R |
| 8,567,094 | B2 * | 10/2013 | Lubart | A43B 13/141 36/35 B |
| 2019/0200700 | A1 * | 7/2019 | Hale | A43B 13/125 |
| 2022/0125158 | A1 * | 4/2022 | Ni | A43B 13/127 |

* cited by examiner

*Primary Examiner* — Timothy K Trieu
(74) *Attorney, Agent, or Firm* — HSML P.C.

(57) ABSTRACT

A torsion-resistant three-density high rigidity midsole includes a midsole body having a front region, a back region, and a middle region integrally connected between the front and back regions. The front region has a front region density and a front region length. The back region has a back region length, and a back region density smaller than the front region density. The middle region has a middle region length, and a middle region density greater than the front region density. A sum of the front and middle region lengths is greater than the back region length. A cushion body is integrally formed on a top surface of the midsole body, and covers the front, middle and back regions. An elastic piece is sandwiched between the top surface of the midsole body and a bottom surface of the cushion body at a position corresponding to the middle region.

5 Claims, 7 Drawing Sheets

TORSION-RESISTANT THREE-DENSITY HIGH RIGIDITY MIDSOLE

CROSS-REFERENCE TO RELATED APPLICATION

This application claims priority to Taiwanese Invention Patent Application No. 111145964, filed on Nov. 30, 2022, and incorporated by reference herein in its entirety.

FIELD

The disclosure relates to a midsole, and more particularly to a torsion-resistant three-density high rigidity midsole.

BACKGROUND

FIG. 1 illustrates a midsole 1 traditionally used for making a shoe. The midsole 1 generally uses ethylene vinyl acetate (EVA) as a molding material, and is formed by foam injection molding. Based on the soft material characteristics of EVA, the midsole 1 has good cushioning and shock-absorbing effects. However, because the material of EVA is too soft, after the shoe is worn for a long time, the midsole 1 becomes flat and dense, making the effect of cushioning and shock-absorbing worse. Furthermore, because the midsole 1 has insufficient rigidity, during actual wearing of the shoe with the midsole 1, if a user steps on the ground with different heights, the midsole 1 will twist left and right or front and back, causing the ankle of a foot of the user to sprain due to relative twisting of the forefoot and the heel of the foot of the user.

Referring to FIG. 2, in order to resolve the aforesaid drawbacks of the midsole 1, a carbon fiber plate 2 (known in the shoe industry as an iron core or shank) is fixed on a top surface of the midsole 1. As such, through the structural rigidity of the carbon fiber plate 2, the degree of left and right or front and back twisting of the midsole 1 can be reduced. However, glue is used to fix the carbon fiber plate 2 to the top surface of the midsole 1, and the use of glue in the manufacturing process will cause chemical volatile agents to pollute the environment. Moreover, the carbon fiber plate 2 cannot resolve the problem of the midsole 1 becoming flat and dense after wearing the shoe with the midsole 1 for a long time.

SUMMARY

Therefore, an object of the present disclosure is to provide a torsion-resistant three-density high rigidity midsole that can alleviate at least one of the drawbacks of the prior art.

According to this disclosure, the torsion-resistant three-density high rigidity midsole includes a midsole body, a cushion body, and an elastic piece. The midsole body includes a front region, a back region, and a middle region integrally connected between the front and back regions. The front region has a front region density and a front region length. The back region has a back region length, and a back region density smaller than the front region density. The middle region has a middle region length, and a middle region density greater than the front region density. Each of the front, back and middle region lengths extends along a longitudinal direction. A sum of the front and middle region lengths is greater than the back region length.

The cushion body is integrally formed on a top surface of the midsole body, and covers the front, middle and back regions. The elastic piece is sandwiched between the top surface of the midsole body and a bottom surface of the cushion body at a position corresponding to the middle region.

BRIEF DESCRIPTION OF THE DRAWINGS

Other features and advantages of the disclosure will become apparent in the following detailed description of the embodiments with reference to the accompanying drawings. It is noted that various features may not be drawn to scale.

DETAILED DESCRIPTION

Figure 1:
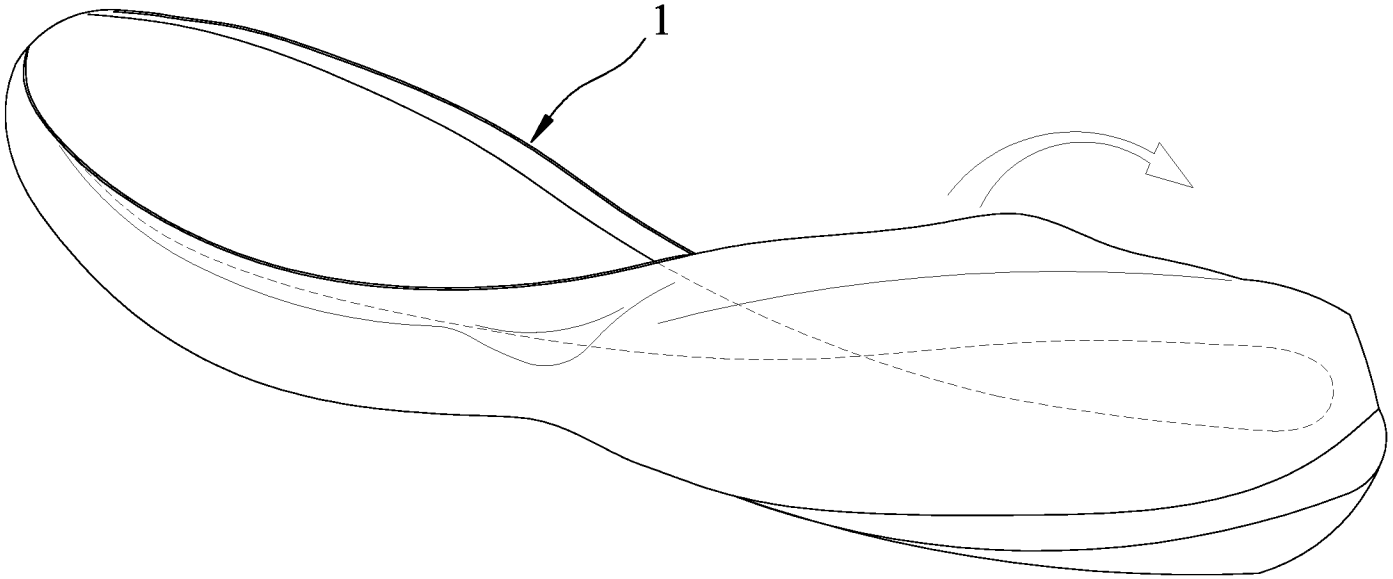
FIG.1 PRIOR ART
FIG. 1 is a perspective view, illustrating how a conventional midsole is twisted.
Figure 2:
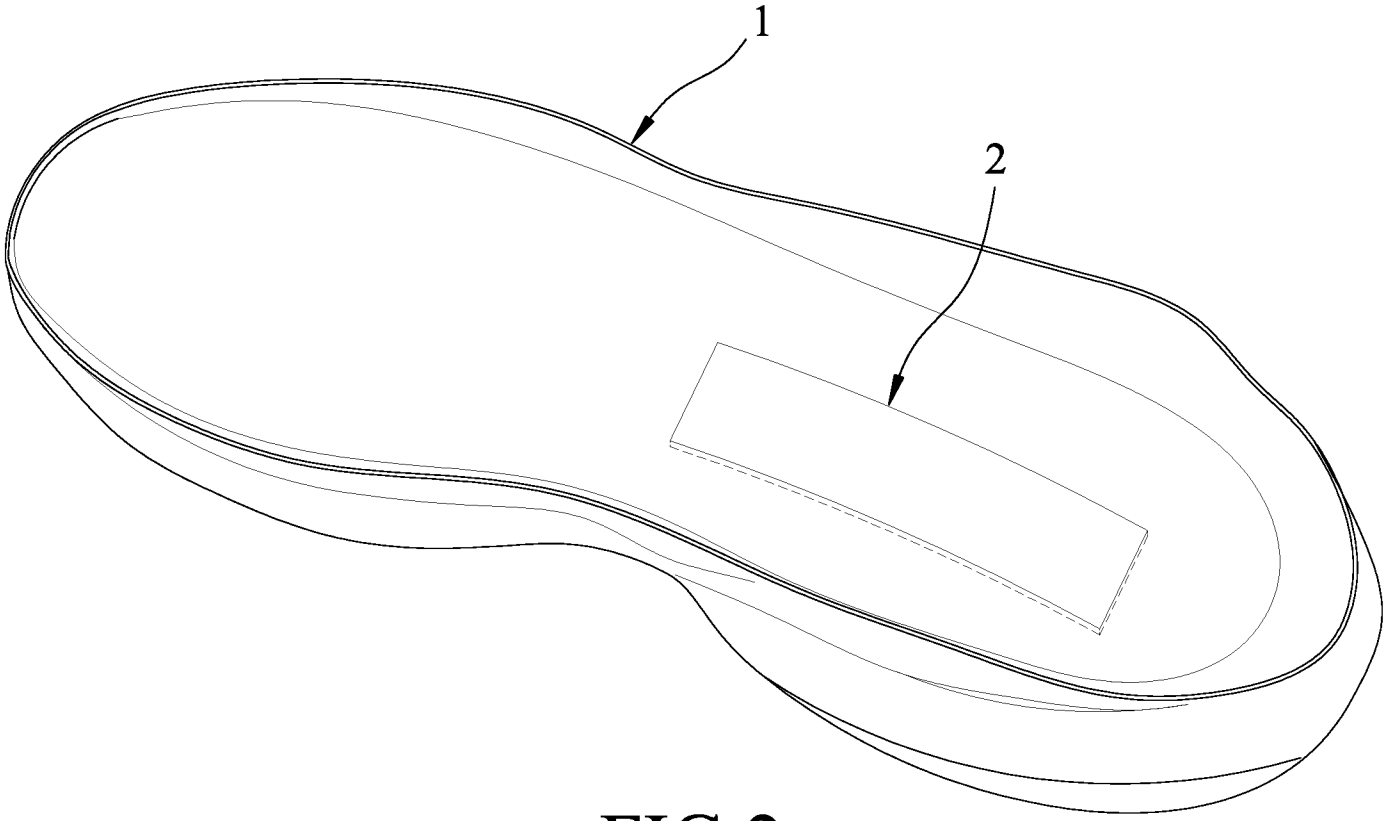
FIG.2 PRIOR ART
FIG. 2 is a perspective view, illustrating a carbon fiber plate disposed on a top surface of the conventional midsole.
Figure 3:
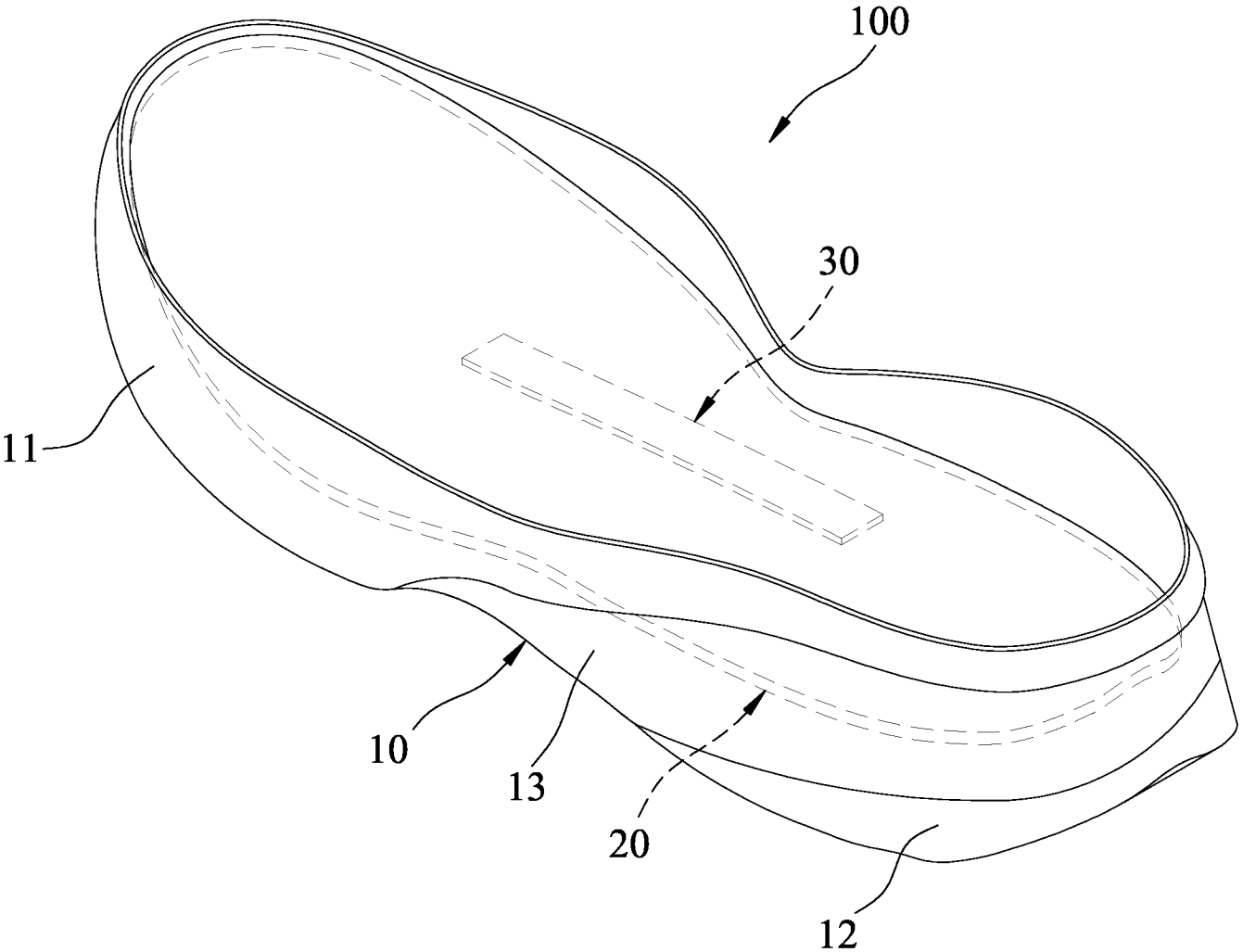
FIG. 3 is a perspective view of a torsion-resistant three-density high rigidity midsole according to an embodiment of the present disclosure.
Figure 4:
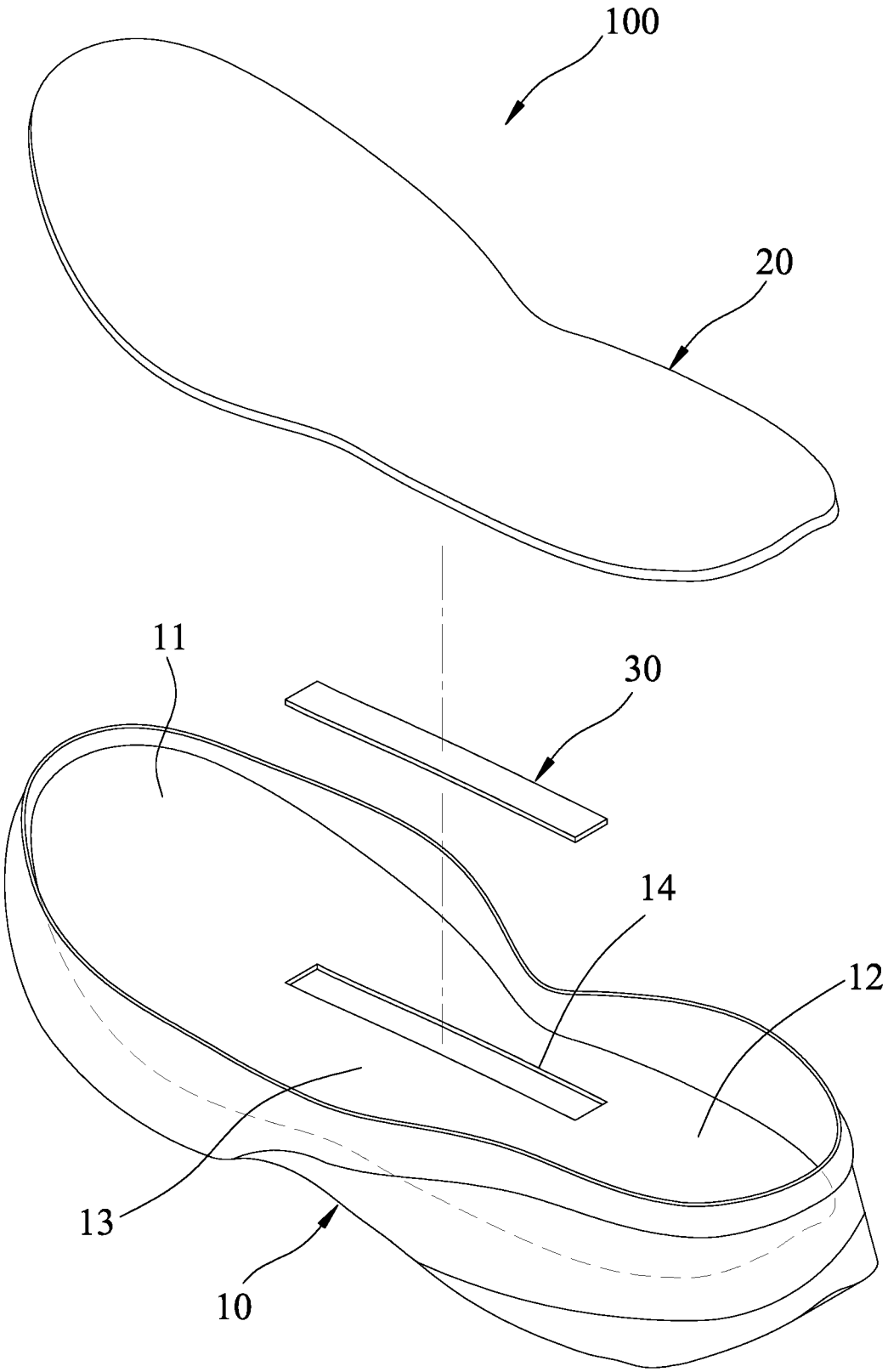
FIG. 4 is an exploded perspective view of the embodiment.
Figure 5:
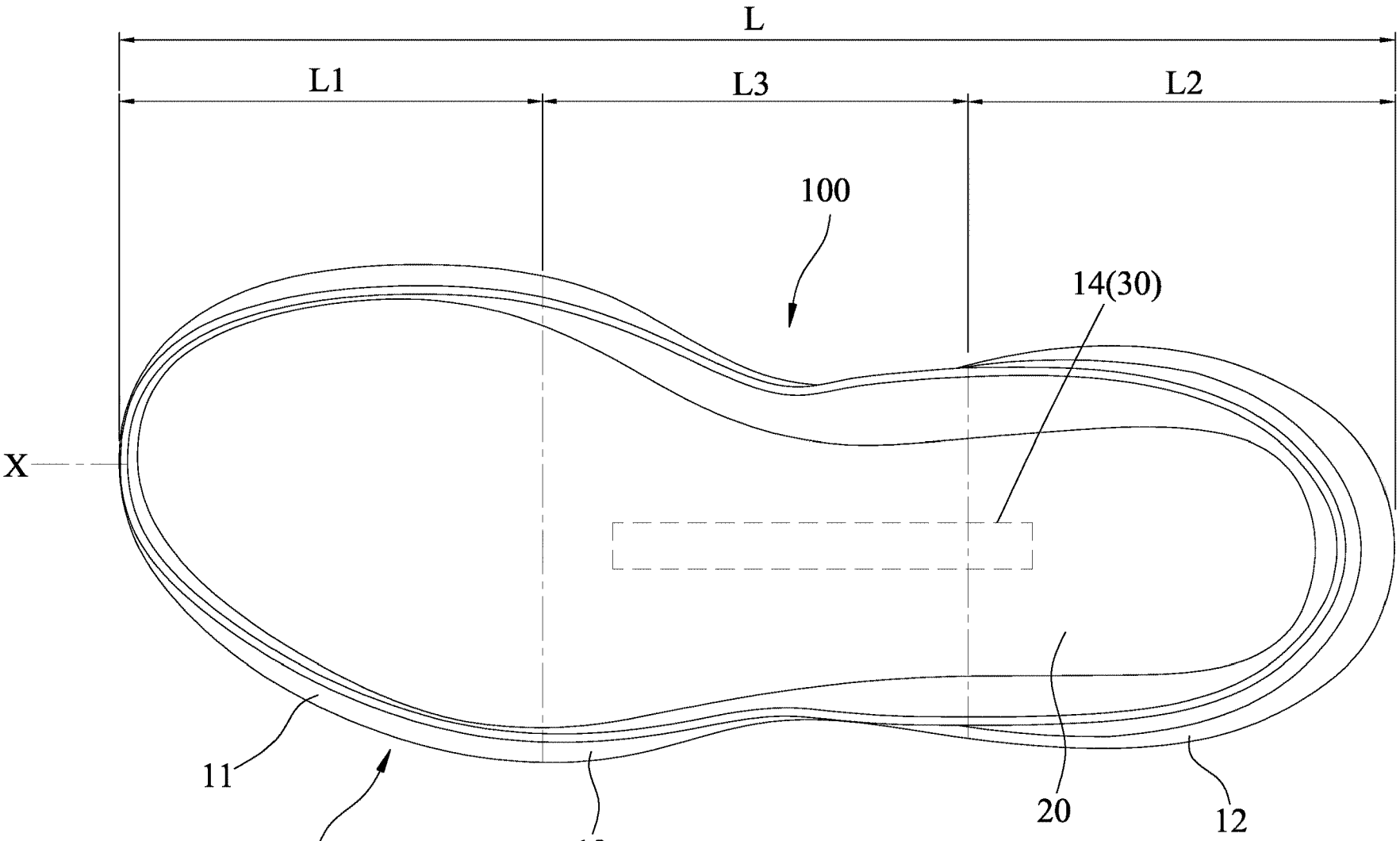
FIG. 5 is a top view of the embodiment.
Figure 6:
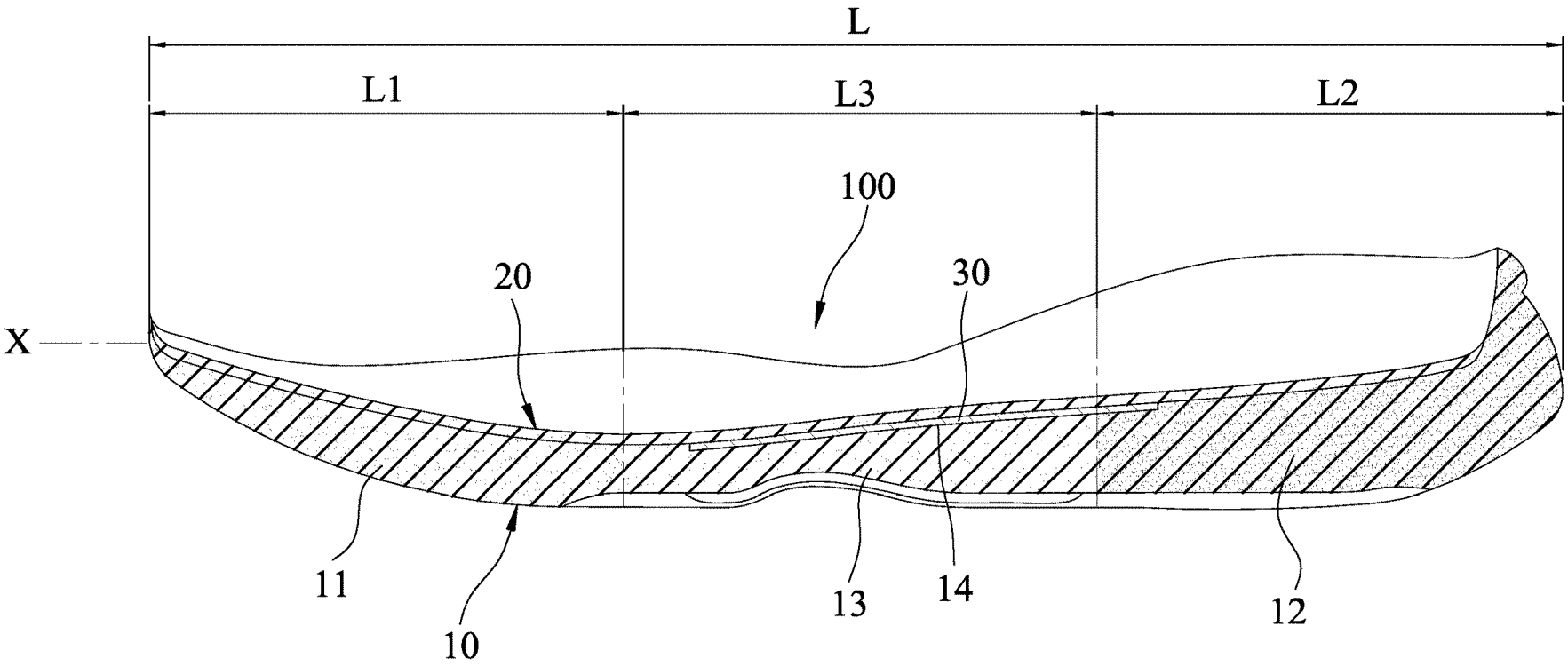
FIG. 6 is a sectional view of the embodiment.

Referring to FIGS. 3 to 6, a torsion-resistant three-density high rigidity midsole 100 according to an embodiment of the present disclosure includes a midsole body 10, a cushion body 20 and an elastic piece 30.

The midsole body 10 includes a front region 11, a back region 12, and a middle region 13 between the front and back regions 11, 12. In this embodiment, a top surface of the midsole body 10 is formed with a groove 14 extending from the middle region 13 to the back region 12.

The front region 11 has a front region density and a front region length (L1). The back region 12 has a back region length (L2), and a back region density smaller than the front region density. The middle region 13 is integrally connected between the front and back regions 11, 12, and has a middle region length (L3), and a middle region density greater than the front region density. Each of the front, back and middle region lengths (L1, L3, L2) extends along a longitudinal direction (X). A sum of the front and middle region lengths (L1, L3) is greater than the back region length (L2).

In this embodiment, the midsole body 10 is made of a thermoplastic polyurethane (TPU) material, the front region density ranges from 0.21 to 0.24 g/cm$^3$, the back region density ranges from 0.15 to 0.2 g/cm$^3$, and the middle region density ranges from 0.25 to 0.3 g/cm$^3$. Furthermore, the midsole body 10 has a tensile strength greater than 15 kgf/cm$^2$, a tear strength greater than 10 kgf/cm, an elongation greater than 250%, a falling ball rebound rate greater than 45%, and a room temperature compression deformation rate less than 10%.

It should be understood that, in other variations of this embodiment, the material of the midsole body 10 may also be one of polyether block amide (PEBAX), polyurethane (PU), and ethylene vinyl acetate (EVA), but not limited thereto.

In this embodiment, the midsole body 10 has a total length (L) extending along the longitudinal direction (X), and each of the front region length (L1), the middle region length (L3) and the back region length (L2) occupies one-third of the total length (L) of the midsole body 10. It should be understood that the front region 11 is a region that approximately corresponds to a forefoot of a foot of a user, the back region 12 is a region that approximately corresponds to a heel of the foot of the user, and the middle region 13 is a region that approximately corresponds to an arch of the foot of the user.

The cushion body 20 is integrally formed on the top surface of the midsole body 10, and covers the front, middle and back regions 11, 13, 12 thereof. In this embodiment, the cushion body 20 has a material similar to that of the midsole body 10.

The elastic piece 30 is sandwiched between the top surface of the midsole body 10 and a bottom surface of the cushion body 20 at a position corresponding to the middle region 13. In this embodiment, the elastic piece 30 is disposed in and extends along a length of the groove 14. The elastic piece 30 can be made of a thermoplastic polyurethane (TPU) material, a carbon fiber composite material, a glass fiber composite material, or a nylon fiber composite material.

In this embodiment, each of the midsole body 10 and the cushion body 20 is made by foam injection molding using a supercritical fluid as a physical foaming agent, and the supercritical fluid is nitrogen. It should be understood that, in other variations of this embodiment, the supercritical fluid may be carbon dioxide, but not limited thereto.

In the manufacturing process of this embodiment, the midsole body 10 is first injection molded, after which the elastic piece 30 is placed in the groove 14 of the midsole body 10. Finally, the cushion body 20 is then injection molded on the midsole body 10 such that the elastic piece 30 is sandwiched between the top surface of the midsole body 10 and the bottom surface of the cushion body 20.

Figure 7:
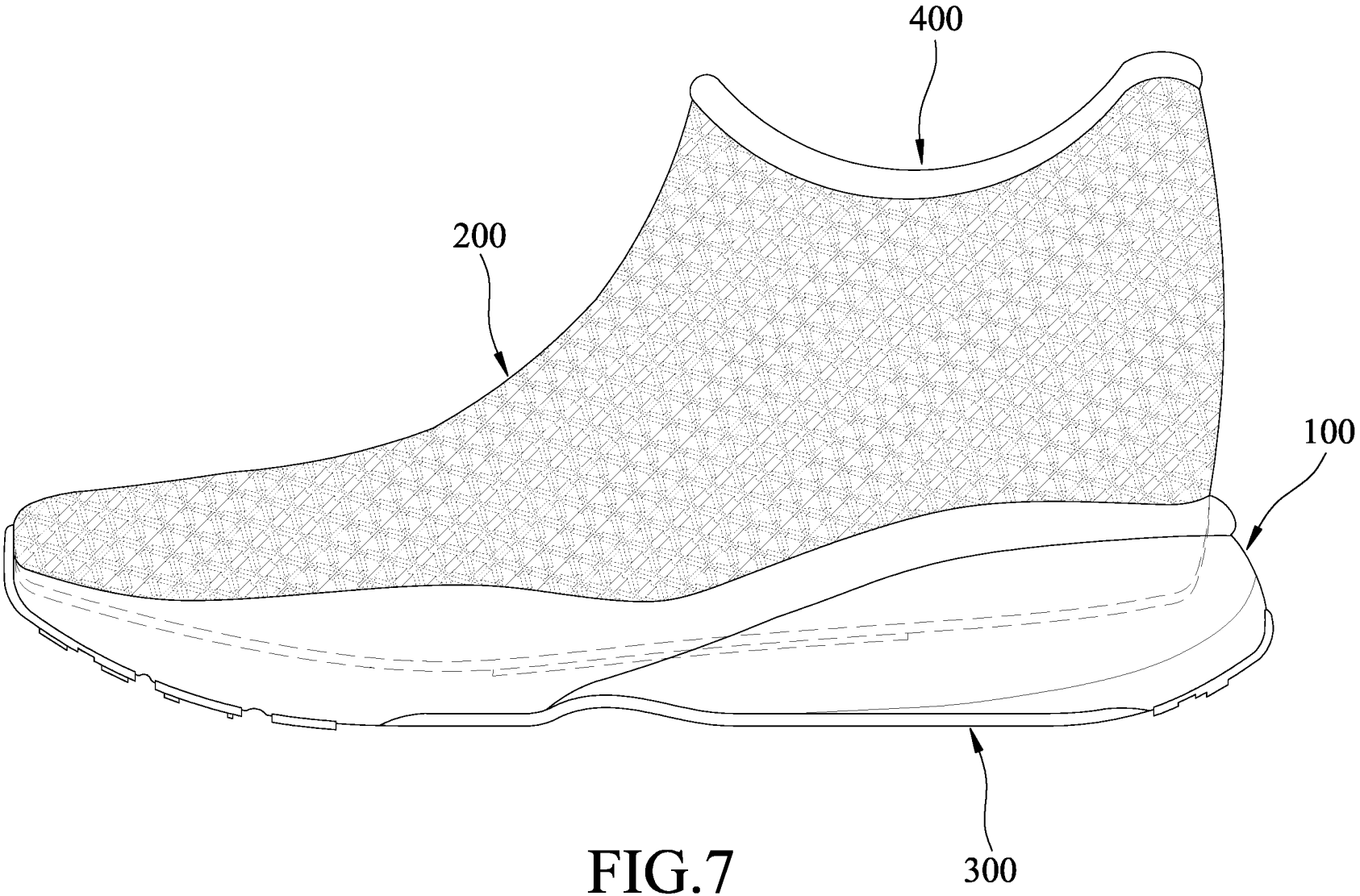
FIG. 7 is a side view of a shoe incorporating the midsole of the embodiment.

Referring to FIG. 7, the midsole 100 of this disclosure can be connected between an upper 200 and an outsole 300 to make a shoe 400.

From the aforesaid description, the advantages of the midsole 100 of this disclosure can be summarized as follows:

1. With the sum of the front region length (L1) and the middle region length (L3) being greater than the back region length (L2), in cooperation with the density of the middle region 13 being greater than the density of the front region 11 and the density of the front region 11 being greater than the density of the back region 12, the front region 11 and the middle region 13 can respectively cover the regions of the forefoot and arch of the foot of the user, and the back region 12 can cover the region of the heel of the foot of the user. Furthermore, the structural rigidity of the middle region 13 is greater than that of the front region 11, and the structural rigidity of the front region 11 is greater than that of the back region 12, in comparison with the prior art, the middle region 13 of the midsole body 10 having the highest density can provide good support and stability to the arch of the foot of the user, and the front region 11 thereof having the second highest density can provide the user with adequate road feel feedback, and can provide auxiliary support and stability to the forefoot of the foot of the user. As such, when the shoe 400 is worn by the user, even if the user steps on the ground with different heights, the midsole body 10 of the midsole 100 of this disclosure is not likely to twist leftward and rightward or forward and backward, and can effectively prevent the foot of the user from spraining the ankle due to relative rotation of the forefoot and the heel of the foot of the user. Moreover, the back region 12 of the midsole body 10 with the lowest density can provide good cushioning and shock-absorbing effects to the heel of the foot of the user.
2. Apart from using the structural rigidity of the elastic piece 30 to further enhance the torsion-resistant capability of the midsole body 10, in comparison with the prior art, this disclosure further uses the cushion body 20 to sandwich the elastic piece 30 between the top surface of the midsole body 10 and the bottom surface of the cushion body 20 during the injection molding process. Hence, in this disclosure, use of glue to fix the elastic piece 30 is not required, and the problem of environmental pollution caused by chemical volatile agents can be effectively avoided.
3. Each of the midsole body 10 and the cushion body 20 is made by foam injection molding using a supercritical fluid as a physical foaming agent, and no chemical foaming bridging agent is added. Hence, the manufacturing process of each of the midsole body 10 and the cushion body 20 is non-toxic, odorless, and has no chemical residues, so that environmental pollution can be effectively reduced. Furthermore, the manufacturing process of each of the midsole body 10 and the cushion body 20 has low energy consumption and low carbon emissions, thereby meeting the requirement of environmental protection. Moreover, the midsole body 10 and the cushion body 20 can be 100% recycled after use and made into new products.

Therefore, the object of this disclosure can indeed be achieved.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects; such does not mean that every one of these features needs to be practiced with the presence of all the other features. In other words, in any described embodiment, when implementation of one or more features or specific details does not affect implementation of another one or more features or specific details, said one or more features may be singled out and practiced alone without said another one or more features or specific details. It should be further noted that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A torsion-resistant three-density high rigidity midsole, comprising:

a midsole body including a front region, a back region, and a middle region integrally connected between said front region and said back region, said front region having a front region density and a front region length, said back region having a back region length and a back region density that is smaller than said front region density, said middle region having a middle region length and a middle region density that is greater than said front region density, each of said front region length, said back region length, and said middle region length extending along a longitudinal direction, a sum of said front region length and said middle region length being greater than said back region length;

a cushion body integrally formed on a top surface of said midsole body and covering said front region, said middle region, and said back region; and an elastic piece sandwiched between said top surface of said midsole body and a bottom surface of said cushion body at a position corresponding to said middle region, wherein said front region density ranges from 0.21 to 0.24 g/cm$^3$, said back region density ranges from 0.15 to 0.2 g/cm$^3$, and said middle region density ranges from 0.25 to 0.3 g/cm$^3$.

2. The torsion-resistant three-density high rigidity midsole as claimed in claim 1, wherein said midsole body has a total length extending along the longitudinal direction, and each of said front region length, said middle region length, and said back region length occupies one-third of the total length of said midsole body.

3. The torsion-resistant three-density high rigidity midsole as claimed in claim 1, wherein said midsole body is made of a material selected from the group consisting of thermoplastic polyurethane (TPU), polyether block amide (PEBAX), polyurethane (PU), and ethylene vinyl acetate (EVA).

4. The torsion-resistant three-density high rigidity midsole as claimed in claim 3, wherein said cushion body is made of a material similar to the material of said midsole body.

5. The torsion-resistant three-density high rigidity midsole as claimed in claim 1, wherein said top surface of said midsole body is formed with a groove extending from said middle region to said back region, and said elastic piece is disposed in and extends along a length of said groove.

* * * * *